US006269555B1

(12) United States Patent
Brown

(10) Patent No.: US 6,269,555 B1
(45) Date of Patent: Aug. 7, 2001

(54) ORTHOTIC ASSEMBLY HAVING STATIONARY HEEL POST AND SEPARATE ORTHOTIC PLATE

(75) Inventor: Dennis N. Brown, Blaine, WA (US)

(73) Assignee: Northwest Podiatric Laboratory, Inc., Blaine, WA (US)

( * ) Notice: Subject to any disclaimer, the term of this patent is extended or adjusted under 35 U.S.C. 154(b) by 0 days.

(21) Appl. No.: 09/576,159

(22) Filed: May 22, 2000

Related U.S. Application Data

(63) Continuation of application No. 09/179,249, filed on Oct. 26, 1998, now Pat. No. 6,125,557.

(51) Int. Cl.[7] ..... A61F 5/14

(52) U.S. Cl. ..... 36/144; 36/25 R; 36/88; 36/44

(58) Field of Search ..... 36/44, 88, 37, 36/81, 80, 140, 144, 25 R

(56) References Cited

U.S. PATENT DOCUMENTS 2,433,329 * 12/1947 Adler et al. .
2,700,230 * 1/1955 Beyer .
3,585,737 * 6/1971 Gilkerson .
3,601,908 * 8/1971 Gilkerson .
4,079,526 * 3/1978 Fukuoka .
4,879,821 * 11/1989 Graham et al. .
4,897,937 * 2/1990 Misevich et al. .
5,722,186 * 3/1998 Brown .
6,125,557 * 10/2000 Brown .

* cited by examiner

*Primary Examiner*—Ted Kavanaugh
(74) *Attorney, Agent, or Firm*—Todd N. Hathaway

(57) ABSTRACT

A two-piece orthotic insert assembly. A post member is fixedly mounted in the heel end of a shoe, and has a generally concave bearing surface. A separate plate member is placed in the shoe so that the heel end thereof rests in the post, the heel cup of the plate member having a generally convex lower bearing surface which engages the concave bearing surface in the post member so as to permit a predetermined range of pivoting motion between the two pieces. The concave upper bearing surface of the post member defines a generally U-shaped bearing area which supports the rear foot portion of the plate at a predetermined angle for heel strike. Following heel strike, the plate member pivots so as to permit a controlled amount of pronation of the foot.

10 Claims, 10 Drawing Sheets

ORTHOTIC ASSEMBLY HAVING STATIONARY HEEL POST AND SEPARATE ORTHOTIC PLATE

This application is a continuation of U.S. application Ser. No. 09/179,249 filed Oct. 26, 1998 now U.S. Pat. No. 6,125,557.

BACKGROUND OF THE INVENTION a. Field of the Invention

The present invention relates generally to orthotic devices for use in shoes, and, more particularly, to an orthotic insert in which there is a stationary heel post and a separate plate member which is pivotable thereon so as to provide a controlled range of motion for the foot.

b. Background Art

Orthotic devices have long been employed with considerable success to treat conditions or otherwise enhance the functions of the human foot, whether for ordinary walking or for various forms of specialized activities, such as skiing, skating, running and so on.

One form of such device has been a built-up structure in which there is a generally rigid, but still somewhat resiliently flexible plate, which usually extends from the heel of the foot to the metatarsal head area (i.e., the area beneath the metatarsal heads of the five phalanges), and a thick, vertical post which is fixedly mounted to the heel end of the plate. Typically, the orthotic plate is constructed of a thin, generally rigid material, such as fiberglass or graphite-resin composite, polyurethane, or a similar material, while the post is frequently formed of a hard material which is capable of supporting the rear foot under the high compressive loads which are developed at heel strike.

Such orthotic devices generally serve to both initially position the foot and then control the foot's motions as it progresses through the gait cycle, e.g., a normal foot should roll (frontal plane motion) about 4°–6° when walking, and perhaps 20°–30° when running. To control the motion of the foot, the plate member flexes resiliently to a controlled degree, and also there is often a need to impart a degree of rocking or eversion/inversion motion of the heel post as well, depending on the demands of the needs of the individuals foot/gait and the intended use. For example, for a high-impact running gait, it is often desirable to effectively increase the inversion of the rearfoot at heel contact, so as to increase the total amount of pronation and therefore the total amount of motion which is available for the balance of the gait cycle.

To adjust the rear foot angulation, and also in those instances where the heel post is supposed to move within the shoe, a common practice has been to grind off or otherwise remove material from the bottom of the heel post, in the area where this engages the insole. For example, FIG. 4 shows an exemplary prior art orthotic device 01, in which a portion of the heel post has been ground off to form a secondary planar surface 03 on the lateral underside of the post. This provides the post with a "bi-planar" bottom, so that it pivots through a controlled angle $\theta_0$, from a first position in which the main bottom surface 04 rests generally flat on the plane 05 of the insole, to a second position in which the upwardly angled surface 03 rests on the insole: For example, at heel strike the rearfoot is generally inverted and the weight is borne mostly on the lateral side of the heel, so that the secondary surface 03 is pressed against the base plane 05, and then as the foot pronates and the weight shifts forwardly and medially, the device rocks onto the main post surface 04.

The purpose of the rocking motion of the heel post is to impart this motion to the plate member 06 which is mounted to the top of the post, the plate member being the component which actually bears against and engages the plantar surface of the person's foot. For several reasons, however, the operation of such devices is frequently less than satisfactory.

For example, achieving the correct pivoting motion is highly dependent on the engagement between the bottom surface of the post and the underlying insole, but the contours of most insoles tend to be irregular and vary greatly from shoe to shoe; in an effort to provide a uniform surface for the post, some practitioners have resorted to filling in the heel area of the insole to provide a more or less flat, uniform surface, but this is an expensive and time-consuming process, and also modifies the shoe so that in some instances it can no longer be used without the orthotic.

Furthermore, the rearward portion of the device must have sufficient clearance between it and the interior of the shoe to allow for the pivoting motion (or else the edge of the device will rub against the inside of the shoe), but where the heel counter of the shoe is particularly tight it may not be possible to establish this clearance, at least without having to modify the device to the point where it is ineffective or uncomfortable to wear. Even in those instances where the heel counter is sufficiently large or loose to accommodate the device, time-consuming trimming and grinding of the device is often necessary to establish the proper motion.

Moreover, even when such devices do function as intended, the results have generally been less than ideal from a biomechanical standpoint. In particular, the pivoting motion of the post, back and forth between the two positions, is somewhat abrupt and irregular in nature, whereas a smoother, more uniform motion would be preferable from the standpoint of both function and user comfort.

Yet another problem which is inherent in conventional posted orthotic devices of the type which has been described above is that fabrication of the built-up structure is notably labor-intensive and expensive from a manufacturing perspective. As was noted above, the plate is frequently formed of a thin, hard material, such as fiberglass or graphite-fiber resin material, while the post is commonly formed of hard rubber or something similar. In order to establish a bond between these two components which will be sufficiently strong and durable to withstand repeated impacts and distortions without separating frequently requires the use of relatively specialized and expensive adhesive compounds. Moreover, extensive and painstaking surface preparation is often necessary in order for these adhesives to work properly, typically involving grinding or otherwise abrading one or both surfaces, applying both primary and final coats of adhesive, heating the components in an oven, and so on. As a result, the need to fixedly mount the post to the orthotic plate adds significantly to the cost of the product.

Accordingly, there exists a need for an orthotic device in which the motion of the plate member which engages the plantar surface of the foot is generated independently of and without being affected by any irregularities or differences in contour which may exist in the heel area of a shoe insole. Furthermore, there exists a need for such an orthotic device in which such motions in a significantly smoother, more uniformed manner. Still further, there exists a need for such an orthotic device which eliminates the need for gluing or otherwise mounting the post and orthotic plate to one another.

SUMMARY OF THE INVENTION

The present invention has solved the problems cited above, and is a two-piece orthotic insert assembly for use in a shoe; as used herein, the term shoe includes all forms of footwear having an insole for supporting a wearer's foot.

Broadly, the orthotic assembly comprises: (a) a post member for substantially stationary mounting in a heel portion of a shoe, the post member having a generally concave upward bearing surface, and (b) a plate member for engaging a plantar surface of a wearer's foot in the shoe, the plate member being substantially free from fixed attachment to the post member and having a generally convex lower bearing surface on a heel portion thereof for resting on the concave upper bearing surface, so as to support the plate member for pivoting on the post member through a predetermined range of motion. The upper and lower bearing surfaces may each comprise a bearing surface which is substantially continuously curved, so that the surfaces cooperate to generate a smooth, substantially uniform pivoting motion between the first and second limits of the range of motion.

The plate member may comprise a thin, substantially rigid plate member having a heel cup portion formed proximate the heel end thereof. The plate member further comprise a forward end portion which is configured to extend in a frontal plane beneath a forefoot portion of the wearer's foot.

The concave upper bearing surface of the post member may comprise a generally U-shaped bearing zone which extends around a heel end of the post member for engaging the lower bearing surface on the plate member in pivoting relationship therewith. The post member may further comprise a downwardly extending recess formed in a central portion of the concave bearing surface for relieving contact pressures between the bearing surfaces in an area directly below the calcaneus of a wearer's foot, with the U-shaped bearing zone extending generally around the perimeter of the recess.

The medial and lateral side portions of the U-shaped bearing zone may lie generally within a first plane which extends at a predetermined angle to the insole of the shoe, the heel cup portion of the plate member being configured to support a heel of a wearer's foot at an initial angle which corresponds to the angle between the first plane and the insole. The assembly may further comprise means for selectively adjusting the angle at which the wearer's heel is supported by the plate member, and this means may comprise at least one wedge member which is selectively mountable to a bottom of the post member so as to adjust the angle between the first plane and the insole of the shoe.

The first limit of the range of motion of the plate member may be an initial, inverted angle at which the wearer's rearfoot is positioned at approximately heel strike, and the second limit may be a second, everted angle to which the wearer's rearfoot shifts following heel strike.

The assembly may further comprise means for selectively adjusting the rate of rotation of the plate member at the second limit of the range of motion. This means may comprise a ramp portion on a medial side of the concave bearing surface of the post member, the ramp portion having a predetermined angle of incline for bearing against the lower bearing surface on the plate member proximate the second limit of the range of motion. The assembly may further comprise means for selectively adjusting the angle of incline of the ramp portion, this means may comprise at least one wedge member which is selectively mountable to the medial side of the lower bearing surface so as to build up the angle of incline of the ramp portion.

The post member may also comprise an extension portion of the lower bearing surface which extends forwardly under a lower surface of the arch portion of the plate member, so as to support the arch portion of the plate member as the weight of a person's foot moves onto the arch area. The post member may be formed of a firm, substantially incompressible material, or the post member may be formed of a soft, resiliently collapsible material so as to absorb shock loads generated by a wearer's foot at heel strike. The extension portion under the arch area may be softer or more rigid depending on the needs of the individual foot.

The present invention also provides a method for positioning and controlling motions of a wearer's foot in a shoe, comprising the steps of: (a) mounting a substantially stationary post member in a heel portion of a shoe, the post member having a generally concave upper bearing surface, and (b) placing in the shoe a plate member for engaging a plantar surface of a wearer's foot, the plate member being substantially free from fixed attachment to the post member and having a generally convex lower bearing surface on the heel portion thereof for resting on the concave upper bearing surface of the post member, so as to support the plate member for pivoting on the post member through a predetermined range of motion.

DETAILED DESCRIPTION a. Overview

Figure 1:
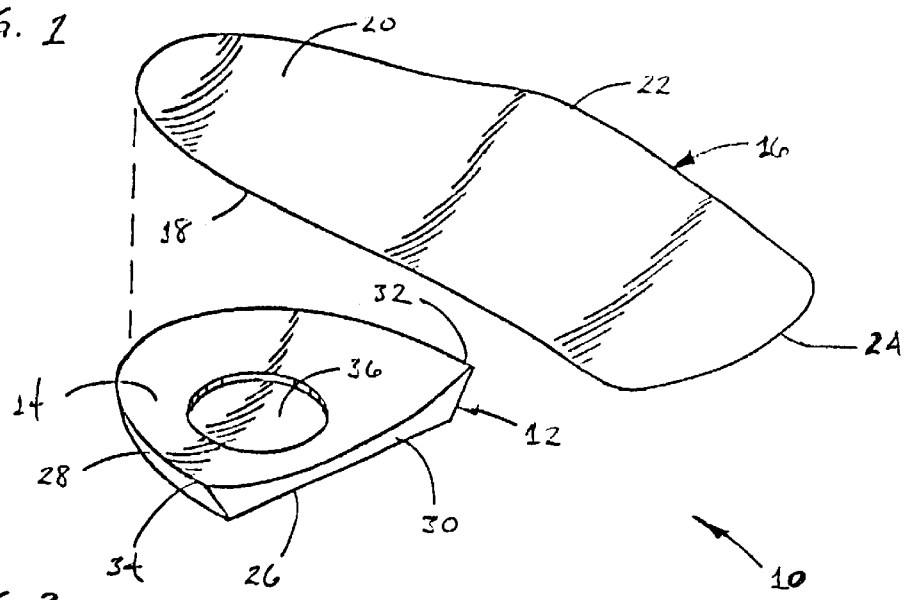
FIG. 1 is a perspective view of the two-part orthotic assembly of the present invention, showing the separate heel post and rigid plate members of the assembly.

FIG. 1 shows an orthotic assembly 10 in accordance with the present invention. As can be seen, this comprises two major components, a post member 12 having a generally concave upper surface 14, and a separate plate member 16 have a generally proximal lower surface 18 which fits into and engages the concave upper surface of the post member so as to allow a pivoting or "rocking" motion between the two pieces.

The plate member includes a heel cup area 20, the upper surface of which engages the plantar surface of the wearer's rear foot, an arch portion 22 which extends beneath the arch of the foot, and a forward end 24 which engages the plantar surface of the forefoot area; in the embodiment which is illustrated, the forward edge 24 is configured to lie generally beneath the metatarsal head area of the foot, so as to lie generally flat with the frontal plane of the foot in the later phases of the gait cycle. The plate member can be formed of any suitable, generally rigid material, with a thin, rigid, resiliently flexible material being preferred; fiberglass-resin and graphite fiber-resin materials are eminently suitable for this purpose, and cast urethane, various plastics, various metals, and other suitable materials may also be used in various embodiments. Also, although not shown in FIG. 1, the plate member may include a cushioning top cover for added wearer comfort.

The post member 12, in turn, is configured to receive and engage the rear foot portion of the plate member. As was noted above, this has a concave upper surface 14, which engages the corresponding convex surface 18 on the bottom of the plate member. The concave upper surface is located a predetermined, spaced distance above the flat, generally planar bottom surface 26 of the post member, the latter being configured to rest in a stationary position atop the insole of the shoe.

The rearward perimeter wall 28 of the post member follows a generally U-shaped contour which is configured to generally match the heel counter of the shoe, and a transverse forward wall 30 extends across the front of the member. As will be described in greater detail below, the forward wall 30 preferably extends at an angle to the long axis of the device (as opposed to being at a right angle thereto), so that the forward medial corner 32 of the post member projects to a somewhat more forward position than the lateral corner 34.

A downwardly extending recess 36 is preferably formed more or less centrally in the concave upper surface 14 of the post member, so as to be positioned generally beneath the calcaneus of the wearer's foot. As will also be described in greater detail below, this serves to reduce contact pressures beneath the plate and post members at the bottom of the heel cup, so that the plate member is supported by the top of the post member along a generally U-shaped, peripheral zone which extends around the heel end of the device, so as to facilitate the positioning of the rear foot and the pivoting motion of the plate member. A generally circular or oval recess is shown in FIG. 1, however, it will be understood that the recess may have any suitable shape, and may be open to the edge or bottom of the post member in some embodiments. Also, in some embodiments the plate may have a corresponding hole formed through it which is positioned generally in register with the underlying recess in the post member so as to completely off-load a given area of the heel, e.g., for accommodation of a heel spur or other condition of the foot.

The body of the post member may be formed of any suitable material having sufficient compressive strength to form the upper concave surface and to perform the rear foot angulation and other functions described herein, with hard rubber being eminently suitable for this purpose; in some embodiments, the post member may be formed in whole or in part of a lower durometer rubber, foam or other resiliently compressible material, so as to provide a degree of cushioning for the foot during heel strike and the initial phases of the gait cycle. It will be understood, however, that low-friction bearing surfaces will generally be preferred in order to facilitate the pivoting action of the plate member.

Figure 2:
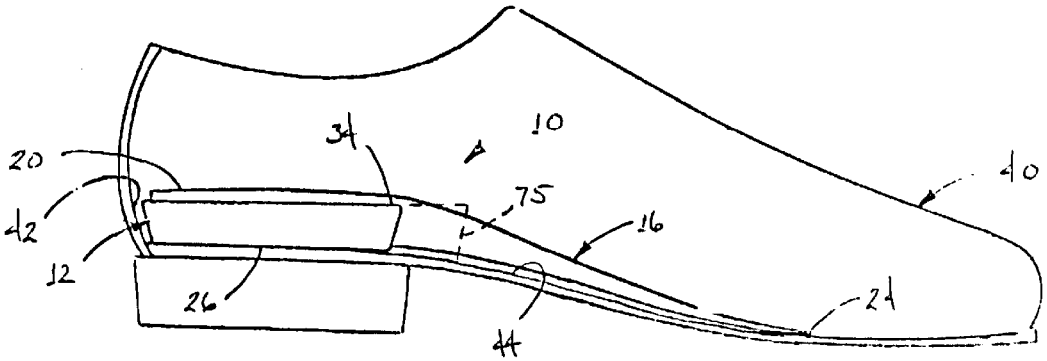
FIG. 2 is an elevational view showing the orthotic assembly of FIG. 1, as installed in an exemplary right-foot shoe.

When the assembly 10 is placed in a shoe 40 as shown in FIG. 2, the post member 12 resides in a stationary position within the heel counter 42, with its bottom surface 26 resting more-or-less flat on the insole 44. The heel cup 20 of the plate member rests within and is supported by the concave upper surface of the heel post, but remains free to pivot from side to side, i.e., to invert and evert about the long axis of the foot therein. The forward edge 24 of the plate member, in turn, rests against the insole in the forefoot area of the shoe, generally in the area beneath the metatarsal heads.

Figure 3:
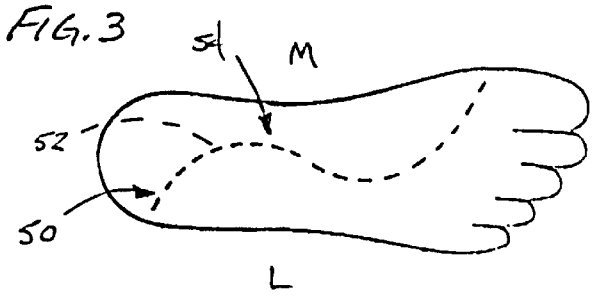
FIG. 3 is a plan, somewhat schematic view of the human foot, showing the general path which is followed by the downward weight on the foot, from the lateral side of the heel at heel strike, towards the medial side of the foot following heel strike.
Figure 4:
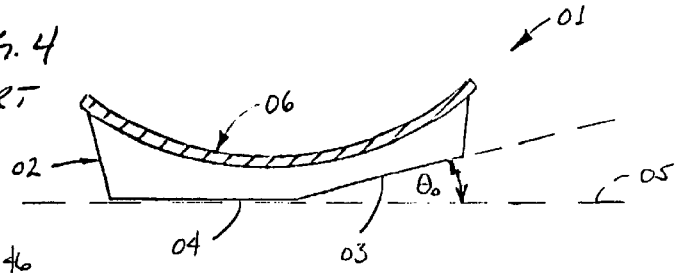
FIG. 4 PRIOR ART
FIG. 4 is a cross-sectional view looking forwardly from the rear of an exemplary prior art orthotic device in which the post is fixedly mounted to the bottom of the orthotic plate.
Figure 5:
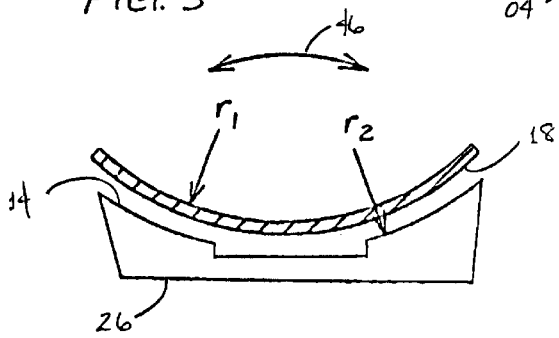
FIG. 5 is another cross-sectional view, looking from the rear forwardly, of an orthotic assembly in accordance with the present invention, showing the two-piece construction having separate heel post and plate members, and the manner in which the plate member is free to pivot against the concave upper surface of the post member.

As is shown in FIG. 5, the radii $R_1$ and $R_2$ of the surfaces 18 and 14 of the plate member and post member are selected to permit a predetermined degree of side-to-side pivoting or rocking motion to develop between the members, as indicated by arrows 46, as the wearer's foot through the gait cycle. As was noted above, and as is shown in FIG. 3, during the initial phases of the gait cycle the wearer's rear foot is generally somewhat inverted (generally, the foot is balanced when it is about 4° inverted) and the weight is borne towards the lateral side, in the area indicated generally at 50. As a result, the plate member 16 is shifted towards the right in FIG. 5 (i.e., towards the lateral aspect of the rear foot) when the heel touches down. Then, as the foot progresses into the gait cycle, the rear foot everts and the weight shifts along path 52 towards the medial side, as indicated at 54 in FIG. 3, until the medial forefoot comes down against the insole along the frontal plane of the foot (typically, at about the 25% point in the gait cycle). As a result, the plate member shifts towards the left (i.e., medial side) in FIG. 5, until the motion of the foot is arrested after a predetermined amount of pronation has occurred.

As will be described in greater detail below, the initial angulation of the rear foot is controlled by the angulation of the upper surface 14 of the host member, in particular the angulation of the general plane in which the U-shaped bearing zone lies. The amount of motion, in turn, and therefore the degree of pronation which is permitted by the device, is limited by engagement of the under surface 18 of the plate with the medial side of the concave post member, and also by the distal medial edge 24 of the plate member coming to rest against the insole of the shoe a long the frontal plane; the manner in which this range of travel can be adjusted will also be described in greater detail below.

b. Structure

FIGS. 6–11 show the structure of the heel post member 12 in greater detail.

Figure 6:
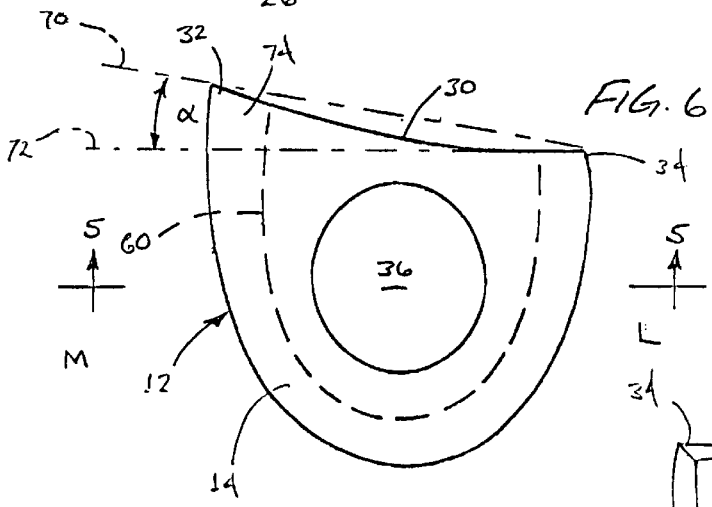
FIG. 6 is a top, plan view of a separate post member in accordance with the present invention, showing the generally U-shaped bearing zone on the concave upper surface of the post member, and the subcalcaneal recess which relieves contact pressures between the surfaces in the area directly beneath the heel cup.
Figure 8:
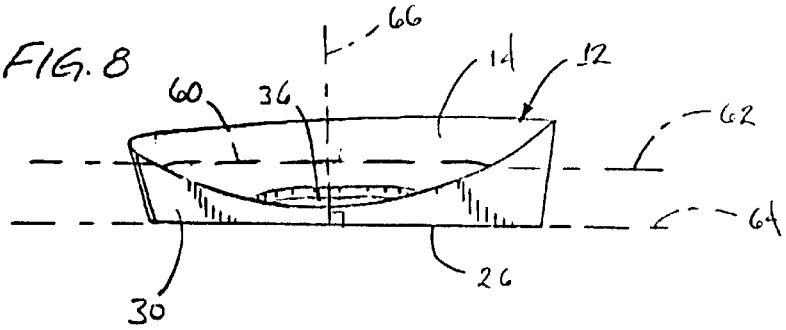
FIG. 8 is a front, elevational view of the post member of FIGS. 6–7, showing the concave upper bearing surface thereof.

Firstly, as was noted above, the main load-bearing engagement between the plate and post members follows a generally U-shaped zone around recess 36 and the heel end of the post, as indicated generally by dotted line 60 in FIGS. 6 and 8. As can be seen in FIG. 8, the U-shaped bearing zone lies generally in a plane 62 which is elevated above a base plane 64 which is defined by the bottom of the post member and the top of the insole of the shoe. The angle of the elevated bearing plane 62 relative to the base plane 64 determines the initial angulation of the plate member 16, and in turn the initial angulation (ordinarily inversion) of the rear foot: the angle of the wearer's rear foot lies generally along an axis which extends perpendicular to the focus of the heel cup, i.e., the central, generally lowermost portion of the heel cup.

In the example which is illustrated in FIG. 8, the bearing plane 62 extends at an angle of about 4° to the base plane 64. As a result, an axis 65 which is perpendicular to the focus of the heel cup of the plate member extends at an angle of about 4° to an axis 66 which is perpendicular to the insole of the shoe. Hence, in this example, the assembly increases the inversion of the wearer's rear foot by about 4° from its natural position; in other words, if the natural inversion of the wearer's rear foot at heel strike is about 4°, the assembly will increase the total angle of inversion to about 8°. As will be described in greater detail below, this angulation is also adjustable in accordance with the present invention in order to meet the requirements of individual feet and/or uses.

Figure 7:
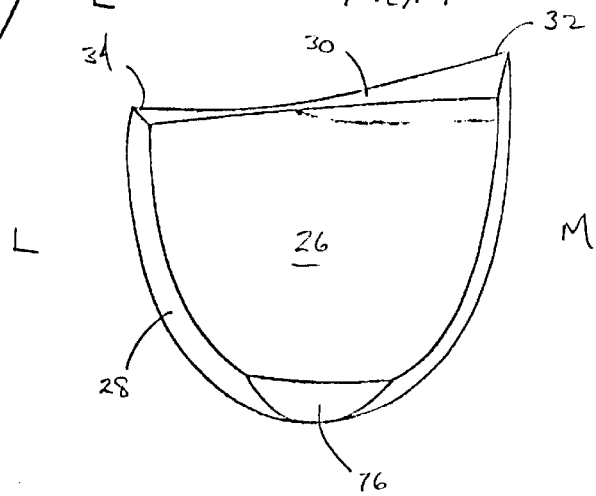
FIG. 7 is a bottom, plan view of the post member of FIG. 6, showing the uniplanar bottom surface and the contours around the heel end thereof.

FIGS. 6 and 7 also show the angled forward edge of the post member. As can be seen, the forward, medial corner 32 of the post member is positioned more forwardly than the lateral corner 34, so that a line 70 drawn between the two defines an angle $\alpha$ with a line 72 which extends perpendicular to the long axis of the assembly. The effect of this angulation is to form an extension 74 of the bearing surface on the medial side of the post member. This provides the rearward end of the arch area of the plate member with additional support and rigidity, so as to enable the assembly to employ a thin and somewhat resiliently flexible plate member for maximum comfort and control. It has found that an edge angle $\alpha$ of about 5–15° is suitable for this purpose, with an angle of about 10–15° being generally preferred.

The angled forward edge of the post member also results in an increased wall length at the front of the post, where this engages the insole, so as to create an enhanced "buttress" effect which helps to prevent the post member from sliding forwardly in the shoe. It will be understood, however, that some embodiments of the present invention the heel post member may lack the medial extension, i.e., the forward edge of the post may extend straight across or some angle other than those that have been described above. Furthermore, in some embodiments all or part of the forward edge of the post member may extend up the sagital plane incline from the rear foot towards the midfoot, as indicated by dotted line image 75 in FIG. 2, so as to form a somewhat upwardly inclined forward portion of the concave heel post which will react against the convex lower surface of the heel cup of the plate member so as to retain the plate member against shifting forwardly in the shoe.

Figure 9:
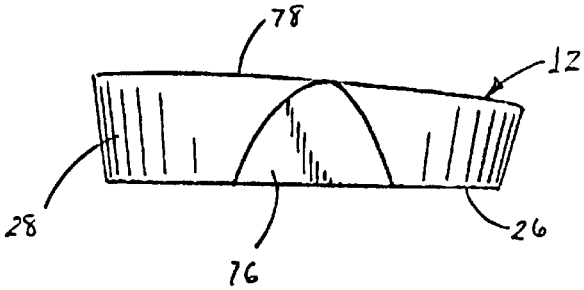
FIG. 9 is a rear, elevational view of the heel post member of FIGS. 6–8, showing the outer wall of the member around the heel end thereof.
Figure 10:
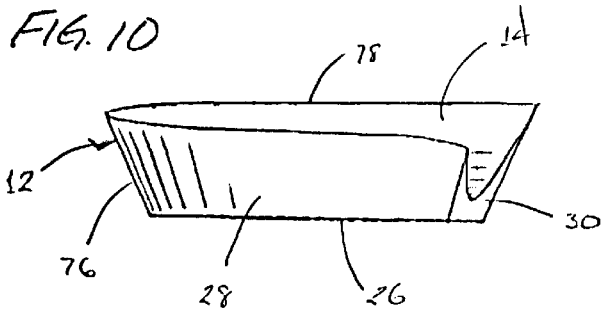
FIG. 10 is a right side elevational view of the right-foot post member of FIGS. 6–9, looking from the lateral towards the medial side thereof.
Figure 11:
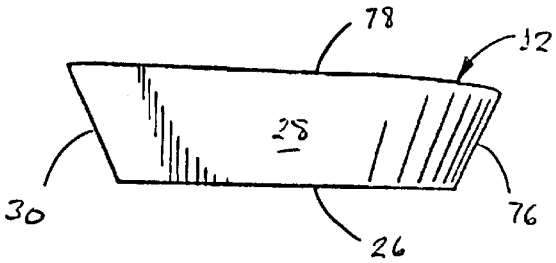
FIG. 11 is a left side elevational view of the heel post member of FIGS. 6–10.

The bottom and rear views in FIGS. 7 and 9 also show an angled cutaway or "skive" 76 which may be provided at the very heel end of the post member. As can be seen, the skive forms a generally flat, planar area which extends from the bottom surface 26 of the post member to near the upper edge 78 of the member, at a somewhat shallower angle than the remainder of the perimeter wall 28. The cutout provides additional clearance at the heel end of the post, so as to permit the post member to be fitted very closely and tightly within the heel counter in FIG. 2 (some space is shown between the rear of the post member and the heel counter of the shoe, however in most instances the post member will be installed tight against the heel counter.

Again, however, it will be understood that this feature may not be present in some embodiments of the invention.

Figure 12:
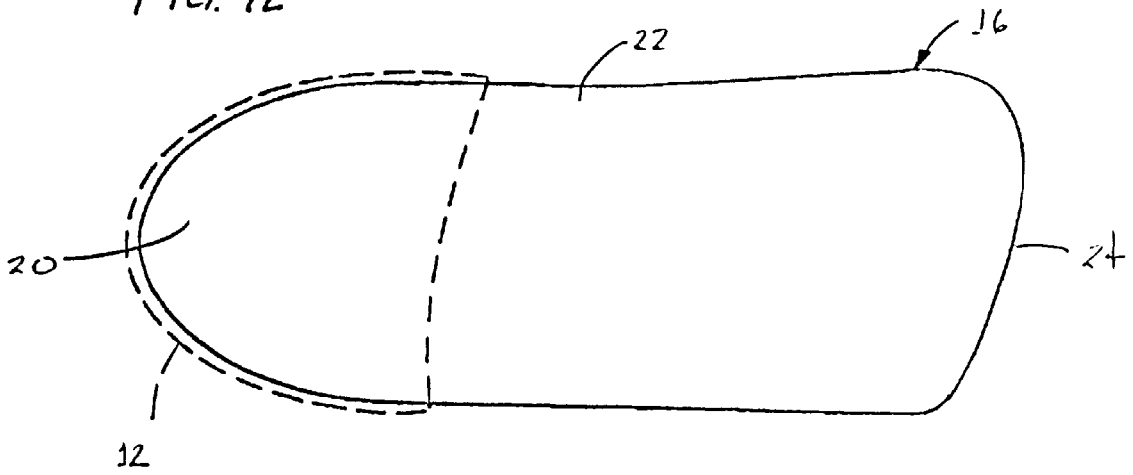
FIG. 12 is a top, plan view of a rigid, resiliently flexible plate member in accordance with the present invention, with the dotted line image showing the manner in which this fits into and engages the post member of FIGS. 6–11.
Figure 13:
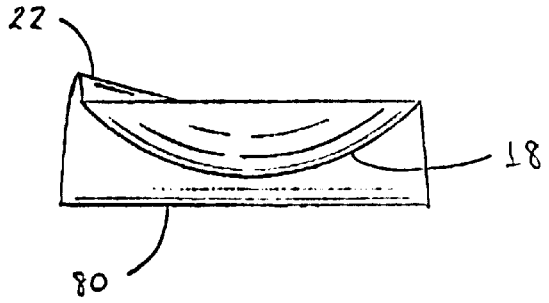
FIG. 13 is a rear, elevational view of the plate member of FIG. 12, showing the heel cup area thereof which engages the corresponding concave upper surface of the heel post member in accordance with the present invention.

FIGS. 12–13, in turn, show the plate member 16 in greater detail, and the manner in which this fits into the post member 12, as indicated by the broken line image in FIG. 12. FIG. 12 shows the post member being somewhat wider than the rear foot portion of the plate member, however, it will be understood that the width of the post member may be wider, equal to, or narrower than the rear foot portion of the plate member, depending on the design of the shoe, the nature of the individual foot, and other considerations.

From the standpoint of operation of the assembly, the principal features of the plate member are the generally convex rear foot bearing surface 18, which engages and pivots on the corresponding surface in the heel post member, and the generally flat lower surface 80 of the forefoot end 24, which extends parallel to the frontal plane when the medial forefoot comes to rest against the insole. The arch area and the contoured upper surface of the plate member are configured to engage and support the plantar surface of the wearer's foot, but may vary somewhat from one assembly to the next; for example, the arch portion may be more pronounced for assemblies which are designed for activities which require greater support in this area, or the arch portion may be more steeply or less steeply down-curved depending on the intrinsic anatomy of the individual foot or the type of shoe with which the device is to be used (e.g., a women's "pump" may require a more steeply down-curved arch portion than a low-heeled shoe).

c. Operation and Adjustment

Because the motion of the plate member, and therefore that of the wearer's foot, develops at the interface between the surfaces 14, 18 of the post and plate members, the function of the orthotic assembly of the present invention is not dependent on or affected by the contour of the shoe insole. The assembly is therefore able to function effectively in a wide variety of shoes, without requiring the painstaking and time-consuming grinding and shaping which is commonly involved in the fitting of prior art devices. Furthermore, the use of separate foot post and plate members eliminates any need to join these together using adhesives or other techniques.

Moreover, because both of the bearing surfaces (i.e., the top surface of the post member and the bottom surface of the plate member) are curved—unlike the generally flat surface of the insole—the assembly is able to generate a very uniform motion, without abrupt transitions or stops during or at the limit of travel.

The range of motion in the direction of eversion/pronation is controlled primarily by the forward end of the plate member coming to rest against the insole along the forefoot plane, the action of the convex bottom of the plate member coming up against the medial side of the concave post member, in turn, can be used to increase or decrease the resistance to the motion in the terminal phase of roll/pronation, thereby slowing the rate of ronation to a great or lesser degree: In general, a slower rate of roll in the terminal phase is preferably for a "loose", less stable foot, while a higher rate of pronation can be used with a more stable foot.

Figure 14:
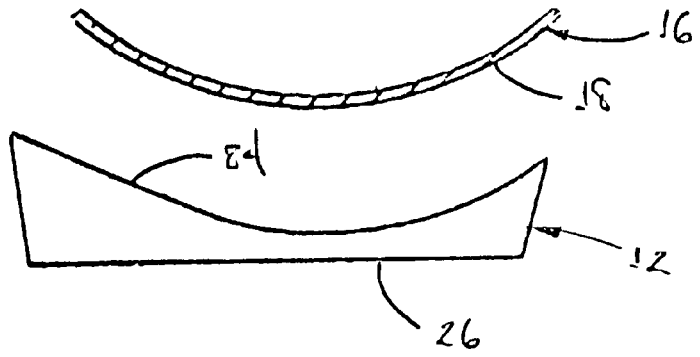
FIG. 14 is a cross-sectional view, looking from the rear forwardly, of a two-part orthotic assembly in accordance with an embodiment of the present invention in which the inclined medial side of the concave bearing surface serves to control the range of rearfoot motion which is allowed by the assembly.
Figure 15:
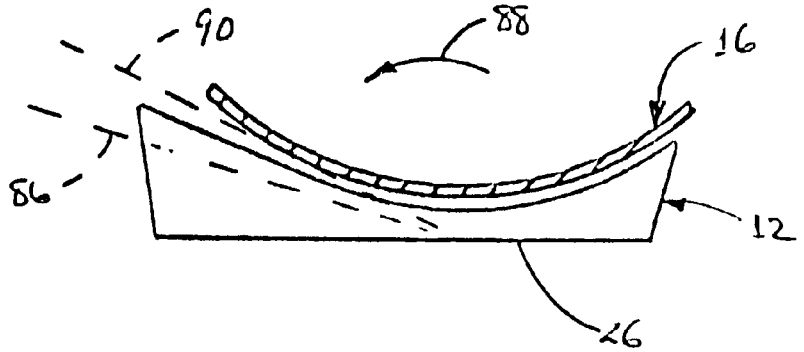
FIG. 15 is a cross-sectional view, similar to FIG. 14, showing the plate member fitted in engagement with the generally concave upper surface of the post member of FIG. 14.

For example, as can be seen in FIGS. 14–15, the rate of the pivoting motion or "roll" towards the medial side of the assembly can be controlled by means of the slope and/or height of a medial ramp portion 84 on the interior of the post member. The greater the incline of the ramp portion, the greater the resistance to pronation during the final phase of the gait cycle: Reducing the angle of the incline, as indicated by line 86 in FIG. 15, will allow a higher rate of rear foot motion in the medial direction, as indicated by arrow 88; conversely, a steeper incline, as indicated by line 90, will reduce the rate of motion.

Figure 16:
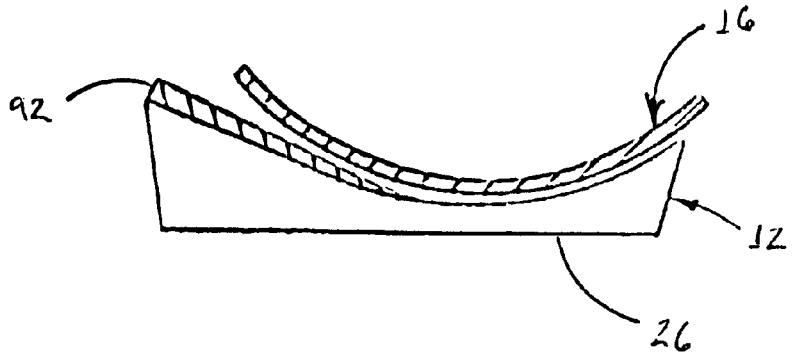
FIG. 16 is a rear, cross-sectional view, similar to FIG. 15, showing an embodiment of the invention in which the rearfoot motion is adjustable by means of wedges of selected sizes which are mountable within the interior of the concave bearing surface so as to control the pivoting motion of the plate member therein.

The assembly may also include means by which the inclination of the medial slope can be selectively adjusted. For example, as is shown in FIG. 16, one or more contoured wedges 92 may be adhered or otherwise mounted to the medial incline so as to selectively build this up and increase its slope. The wedge members may have a tapered contour, with the thin edge being positioned towards the bottom of the concave post surface 14 and the thicker edge being towards the edge of the post, or other shapes of wedges may be employed, depending on the application and the intended motion of the plate member. Moreover, a series of interchangeable wedge members may be provided, together with a "standard" shape of post member having a nominal medial incline to which the customer or a foot care practitioner can add one or more of the wedges depending on intended use, comfort or other needs of the individual foot, and so on. Consequently, this feature provides the device with a high degree of adjustability at minimal cost.

Figure 17:
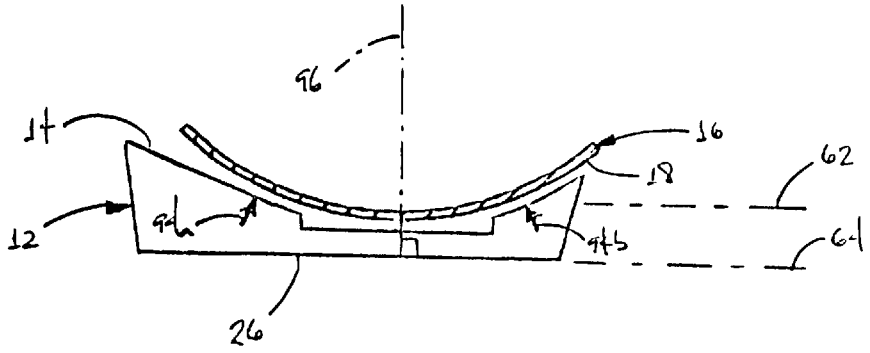
FIG. 17 is an end, cross-sectional view similar to FIG. 15, showing the initial angulation of the rearfoot which is provided by the two-piece assembly of the present invention.

As was noted above, the angle at which the assembly positions the wearer's rear foot during heel strike and the initial phases of the gait cycle can also be adjusted. For example, FIG. 17 shows a post member similar to that in FIG. 8, in which the bearing zone (as represented by arrows 94*a*, 94*b* on the medial and lateral sides of the heel cup) lies in a plane 62 which is generally parallel to the plane 64 of the post bottom/insole; in this case, an axis perpendicular to the heel cup generally matches an axis 96 perpendicular to the insole, i.e., the assembly adds little or no angulation of the rear foot relative to the insole.

Figure 18:
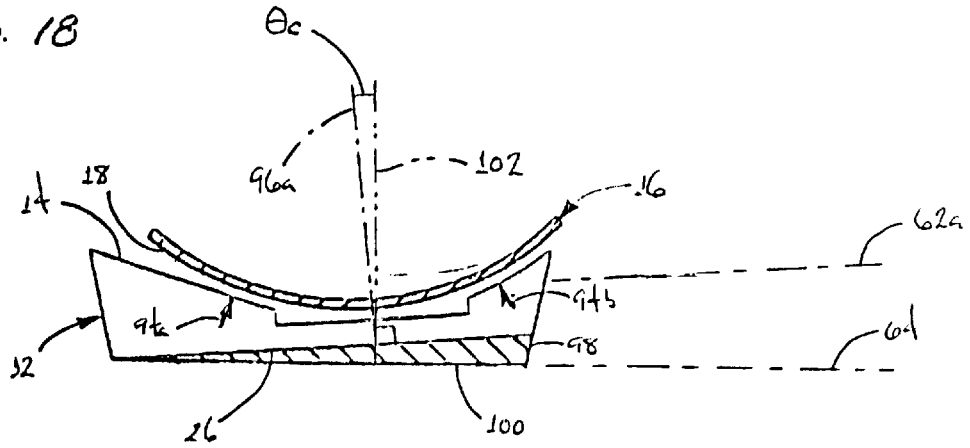
FIG. 18 is a rear, cross-sectional view, similar to FIG. 17, showing the manner in which the angulation of the rear foot is adjustable by adding one or more wedges to the planar bottom of the heel post member.
Figure 19:
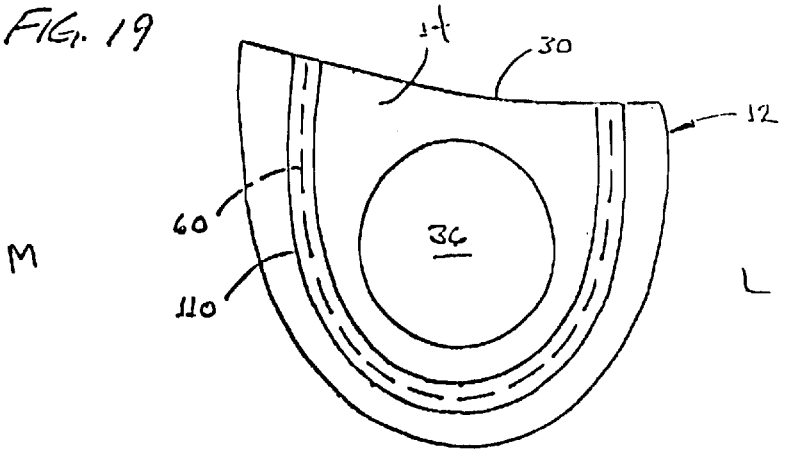
FIG. 19 is a top, plan view, similar to FIG. 6, showing an embodiment of the present invention in which the U-shaped bearing zone of the heel post member is enhanced or provided by a raised ridge which extends around the interior of the concave surface thereof.

Then, to selectively increase the angulation, a wedge or other support can be inserted under one side or the other of the post member. For example, as is shown in FIG. 18, a wedge member 98 may be mounted to the bottom of the post member with its thickest edge towards the medial side, so as to form a second, angled lower surface 100 which engages the insole so as to shift the plane of the bearing zone to an increased angle, as indicated at 62*a*. This in turn shifts angle of the plate member so as to increase the inversion of the rear foot, as indicated at 96*a*, by a predetermined angle $\theta_C$. If desired for a particular application, a wedge can be mounted to the bottom of the post member in a reverse manner, so as to increase eversion of the rear foot.

Accordingly, by mounting selected wedges to the bottom of the post member, the initial angulation of the rear foot can be adjusted as desired. While the amount of angulation will again depend on the nature of the individual foot and the intended use of the device, the angle $\theta_C$ will typically be in the range from about 0°–8°, with an angulation of about 4°–6° being common. Moreover, a series of adjustment wedges can be supplied for use with a standard post member so as to be able to increase the angulation of the rear foot by incremental amounts, e.g., 2°, 4°, 6°, 8°, and so on. Also, the wedges can be formed of a material having a stiffness greater than or comparable to that of the body of the post member, or they may be formed of a softer, more compressible material to provide more of a cushioning effect at the end of travel.

Figure 20:
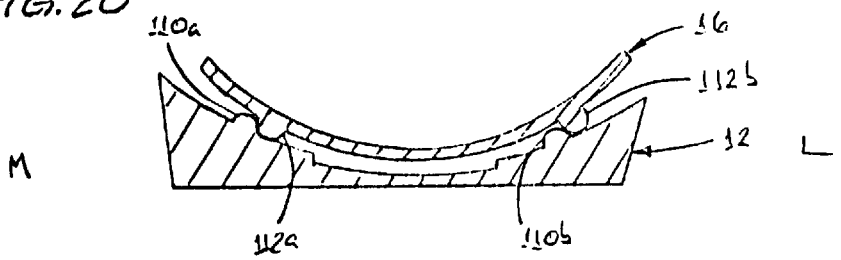
FIG. 20 is a rear, cross-sectional view, similar to FIG. 7, showing the manner in which the U-shaped ridge of the post member of FIG. 18 cooperates with a corresponding ridge on the bottom of the plate member so as to support the heel cup of the plate member at it predetermined initial angle.

FIGS. 19–22 illustrate embodiments of the invention in which adjustment of the rear foot angulation is achieved in a somewhat different manner. In these instances, the U-shaped bearing zone 60 is formed by a raised rib 110 which extends around the interior of the concave surface of the post member, this being shown somewhat exaggerated in the figures for purposes of illustration. As can be seen in FIG. 20, the medial and lateral portions 110*a*, 110*b* of the raised rib on the post member react against the medial and lateral portions 112*a*, 112*b* of the corresponding raised, downwardly projecting rib on the bottom of the plate member 16 to position the rear foot portion of the plate member at a predetermined degree of inversion at heel impact. Then, following heel impact, the plate member rotates on the post member for pronation of the foot, in the manner described above.

Figure 21:
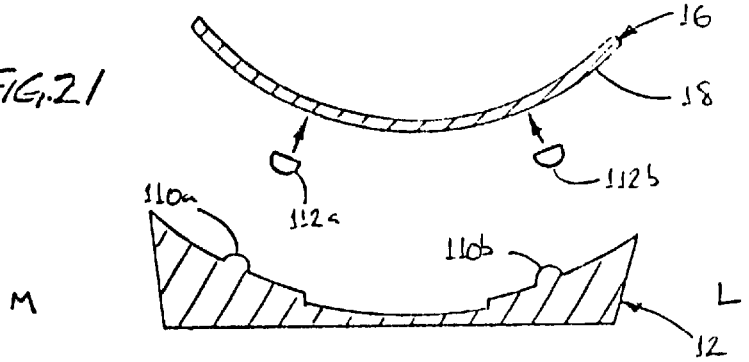
FIG. 21 is a cross-sectional view, similar to FIG. 20, showing an embodiment in which strips forming the ridge on the bottom of the plate member are selectively mountable thereon so as to adjust the initial angle of the heel cup.

The upper ridge 112 may be formed an integral part of the plate member, or as is shown in FIG. 21, the ridge may be made as a separate piece or pieces (i.e., the medial and lateral sides of the ridge 112*a*, 112*b* may be formed as two separate strips) which are mountable to the lower surface 18 of the plate member in a selected position, as indicated by the arrows in FIG. 21. For example, a practitioner may be provided with a standard post and plate member, and then the ridge or ridges 112*a*, 112*b* can be mounted in selected positions to provide a degree of inclination as needed by an individual foot.

Figure 22:
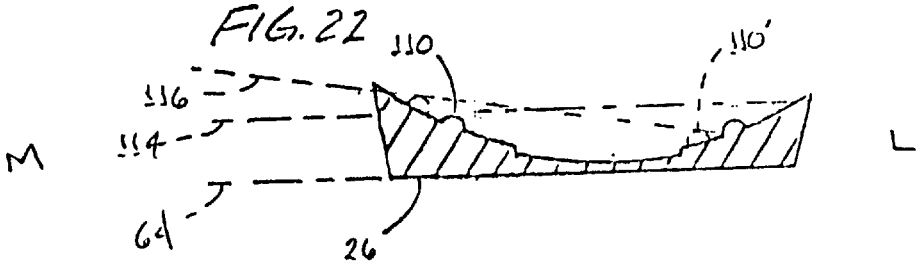
FIG. 22 is a cross-sectional view, similar to FIG. 20, showing the manner in which the initial angulation of the rear foot can be adjusted by adjusting the position of the U-shaped ridge within the post member.

As can be seen in FIG. 22, the angular adjustment can also be made by changing the position of the raised rib 110 within the interior of the post member. For example, in a first configuration, the U-shaped ridge 110 may be relatively level within the post member so as to define a somewhat horizontal support plane 114, thereby imparting only a small degree of additional angulation to the rear foot. To adjust this angulation, the position of the ridge may be shifted within the post member, as indicated by dotted line image 110', so that the ridge is higher on one side (e.g., the medial side) and lower on the other. This forms a second, angled support plane 116 which shifts the angle of the plate member and thereby increases/decreases the initial inversion of the rear foot by a predetermined amount. The raised ridge 1lo may be molded or otherwise formed as an integral part of the post member, or this may be a separate piece which is adhered or otherwise mounted to the interior surface of the post member in a selected orientation.

Figure 23:
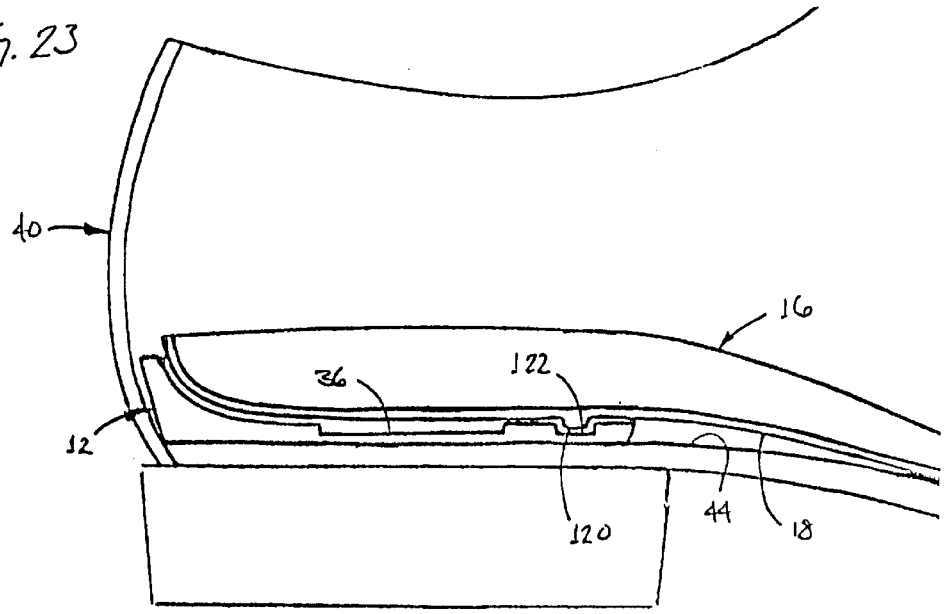
FIG. 23 is a side, cross-sectional view of the rear foot portion of a shoe and orthotic assembly in accordance with an embodiment of the present invention in which the plate member has a downwardly projecting transverse ridge which engages a corresponding groove in the post member to prevent the plate member from sliding forwardly in the shoe.
Figure 24A:
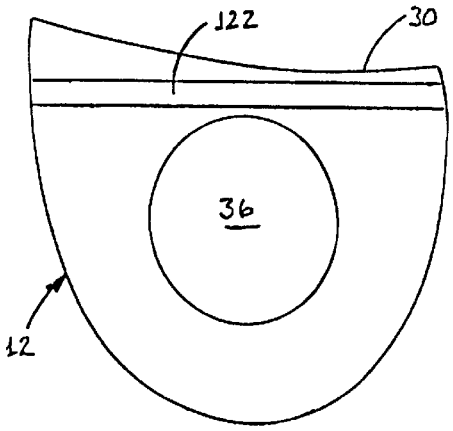
FIG. 24A is a top, plan view of the post member of the orthotic assembly of FIG. 23, showing the transverse groove which is formed in the upper surface thereof.
Figure 24B:
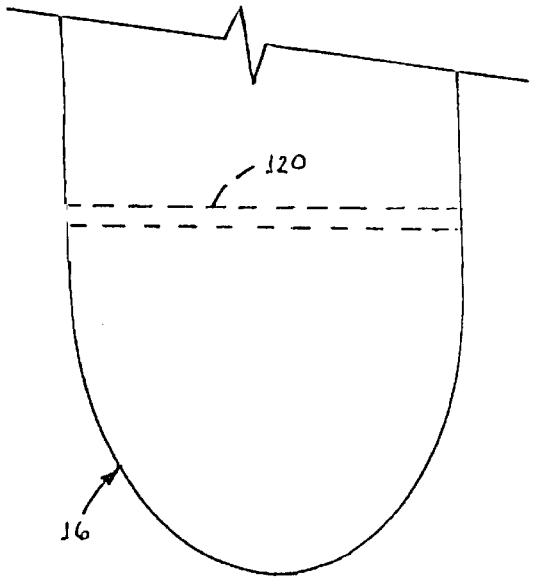
FIG. 24B is top, plan view of the rear foot portion of the plate member of the orthotic assembly of FIG. 23, with the dotted line image showing the downwardly projecting, transverse ridge thereon which engages the groove and the post member.

FIGS. 23 and 24A–24B illustrate an embodiment of the present invention in which the plate member engages the stationary post member during use so as to hold the former in place against shifting forwardly in the shoe. In this embodiment, a transversely extending ridge 122 projects downwardly from the bottom surface 18 of the plate member 16, and is received in a corresponding channel or groove 120 which is formed in the upper surface of the post member. Since the post member 12 is mounted firmly to the insole 44 of the shoe, the engagement between the groove 122 and the ridge 120 prevents the plate member from shifting forwardly in the shoe as the person is walking, while still allowing the plate member to rock from side to side in order to generate the desired motion.

As can be seen in FIGS. 24A and 24B, the groove 122 and ridge 120 extend generally transverse to the long axis of the device/shoe, and the groove is preferably sized somewhat wider than the ridge so as to avoid friction which would interfere with movement between the two parts. Also, it will be understood that in some embodiments the ridge may be formed on the upper surface of the post member and the groove on the bottom of the plate member, the reverse of the arrangement which is shown in FIGS. 24A–24B.

Figure 25:
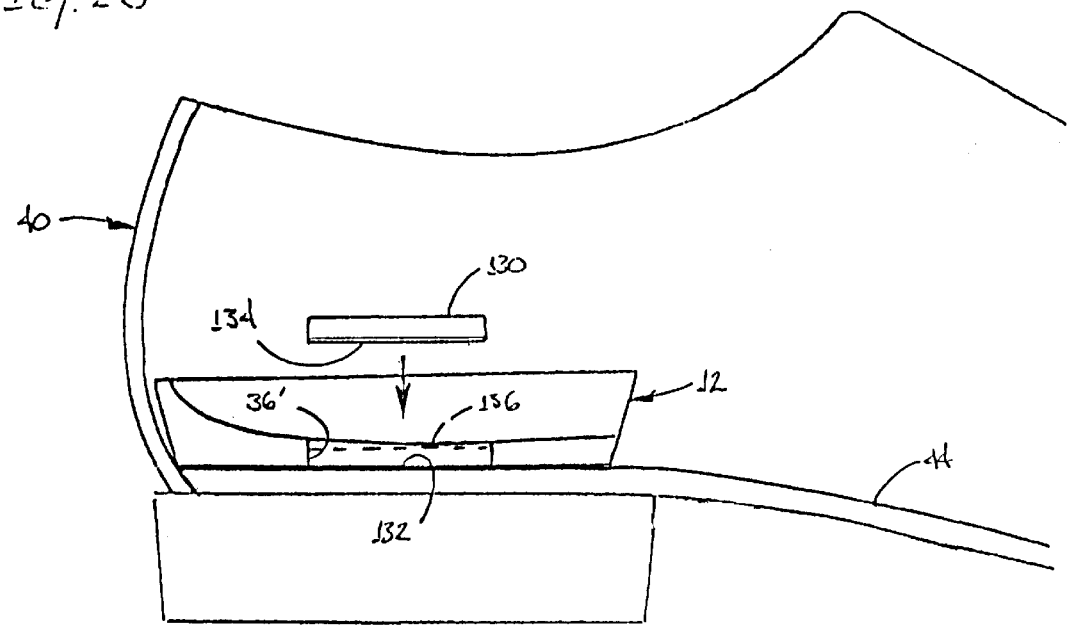
FIG. 25 is a side, cross-sectional view of the rear foot portion of a shoe and the post member of an orthotic assembly in accordance with the present invention in which the post member is held in position in the shoe by a plug member which is mounted to the top of the insole and which fits within the corresponding opening and the post member.

FIG. 25, in turn, illustrates an embodiment of the present invention in which the heel post member 12 is removable from the shoe, and is anchored in place by means of a plug 130 which is attached to the insole. As can be seen, in this embodiment the central recess 36' extends completely through the post member, so as to form a hole which exposes an area 132 of the insole. The plug 130 has an adhesive lower surface 134, and is sized to pass through and fit closely within the opening 36'.

Accordingly, to install the assembly in the shoe, the post member is first fitted into the heel end of the shoe at the desired location. The adhesive layer of the plug is then exposed (e.g., by removing a paper or plastic backing), and the plug is inserted downwardly through the opening 36', in the direction indicated by the arrow in FIG. 25, so that the adhesive surface contacts and engages the area 132 of the insole within the opening. Downward finger/thumb pressure can be applied as necessary to insure firm engagement between the plug and insole, and the thickness of the plug member is preferably such that its upper surface rests at or slightly below the top of the recess 36', as indicated by dotted line image 136 in FIG. 25. The plug 130 may be formed of any suitable material, with firm foam material being eminently suitable for this purpose. Moreover, the plug member may have any suitable shape, and may also be formed as a plurality of plugs in some embodiments; also, in some embodiments the opening for receiving the plug member may be formed as a recess in the bottom of the post member rather than as a hole passing completely therethrough.

Once the plug 130 has been attached to the insole 44 in the manner described, this serves to stabilize the post member 12 and prevent it from shifting within the shoe. Moreover, as compared to a post which is glued or otherwise permanently mounted in the shoe, this arrangement allows the post to be removed and placed in another shoe at will, thereby enabling the owner to use the orthotic assembly with more than one pair of shoes. It will also be understood that in some embodiments the locating plug may be formed as a permanent part of the shoe or insole itself; for example, the plug may be formed as a part of the insole or heel of the shoe, for engaging and stabilizing a plurality of different insoles or orthotic devices which are interchangeably mountable in the shoe.

Figure 26:
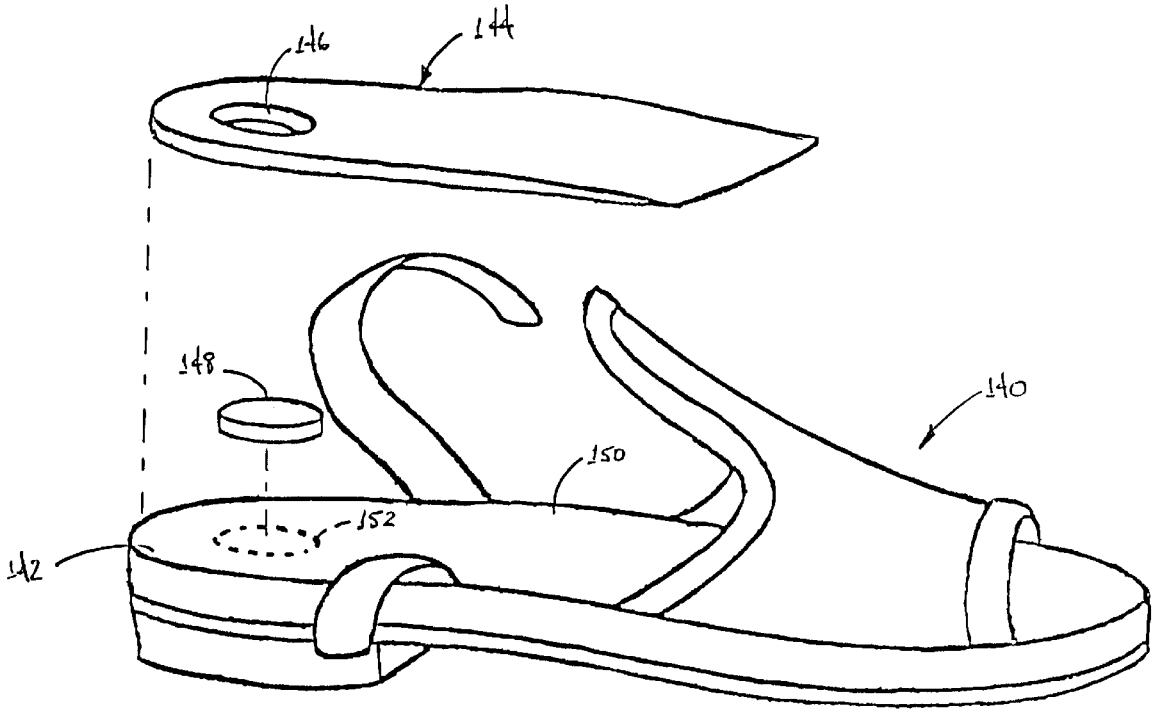
FIG. 26 is a perspective view of an exemplary sandal, showing the manner in which an orthotic device may be mounted and held in position therein using a plug member similar to that which is shown in FIG. 25.

Moreover, as can be seen in FIG. 26, a locating plug of this type can be employed to mount a unitary, one-piece orthotic device in a shoe, as well as the two-piece type system described above. This is particularly advantageous in the case of sandals and similar types of footwear, being that the open-ended/sided structure of sandals (particularly in the heel area) has long presented a problem as to how to get an orthotic device to stay in place, yet still be removable so that it can be used with other pairs of shoes.

Accordingly, FIG. 26 shows a sandal 140 having a typical open-sided heel end 142. In accordance with the present invention, an orthotic insert 144 is provided which is sized to fit within the sandal, and which includes an opening 146 which is more or less centered in the heel cup of the device. A corresponding locating plug 148 is provided which is sized to interfit with the opening 146, and which is adhered or otherwise mounted to the top of the sandal insole 150 in a predetermined position near the heel end thereof, as indicated at 152 in FIG. 26. As with the two-piece system described above, correct positioning of the locating plug can be achieved by first placing the orthotic insert 144 in a selected position atop the insole of the sandal or other article of footwear, and then pressing the locating plug 148 downwardly through the opening 146 into adhesive contact with the surface of the underlying insole. Moreover, several sets of the locating plugs 148 can be provided so as to permit the orthotic to be used interchangeably with multiple pairs of sandals or other shoes.

It is to be recognized that various alterations, modifications, and/or additions may be introduced into the constructions and arrangements of parts described above without departing from the spirit or ambit of the present invention as defined by the appended claims.

What is claimed is:

1. An orthotic insert assembly for use with a shoe having an insole, comprising:

a post member for substantially stationary mounting in a heel portion of said shoe, said post member having an upper surface;

a thin, substantially rigid plate member for engaging a plantar surface of a wearer's foot in said shoe and having a heel cup formed in a heel end thereof, said plate member being substantially free from attachment to said post member and having a lower surface on said heel portion thereof for resting in engagement with said upper surface of said post member; and ridge members extending along medial and lateral sides of said heel cup so as to form a bearing interface between said upper surface of said post member and said lower surface of said plate member which enables said plate member to pivot on said post member through a predetermined range of motion.

2. The orthotic insert assembly of claim 1, wherein said ridge members are formed on said lower surface of heel end of said plate member.

3. The orthotic insert assembly of claim 2, wherein said upper surface of said post member comprises:

a generally concave upper bearing surface for forming a sliding engagement with said ridge members on said lower surface of said plate member.

4. The orthotic insert assembly of claim 1, wherein said ridge members are formed on said upper surface of said post member.

5. The orthotic insert assembly of claim 4, wherein said lower surface of said plate member comprises:

a generally convex lower bearing surface for forming a sliding engagement with said ridge members on said upper surface of said post member.

6. The orthotic insert assembly of claim 5, wherein said ridge members comprise:

a generally u-shaped ridge which extends around a heel end of said post member and along medial and lateral sides thereof.

7. The orthotic insert assembly of claim 5, further comprising:

a stop member formed on said lower surface of said plate member for reacting against at least one of said ridge members on said upper surface of said post member so as to position said plate member at a predetermined initial angle when a wearer's foot in said shoe is in a heel-strike position.

8. The orthotic insert assembly of claim 7, wherein said stop member comprises:

at least one secondary ridge member formed on said lower surface of said plate member for engaging one of said ridge members on said upper surface of said post member.

9. The orthotic insert of claim 8, wherein said at least one secondary ridge member is configured to be selectively mountable at predetermined locations on said lower surface of said plate member so as to adjust said initial angle at which said plate member is positioned when a wearer's foot in said shoe is in a heel-strike position.

10. An orthotic insert assembly for use with a shoe having an insole, comprising:

a post member for substantially stationary mounting in a heel portion of said show, said post member having a generally concave upper surface;

a thin, substantially rigid plate member for engaging a plantar surface of a wearer's foot in said shoe and having a heel cup formed in a heel end thereof, said plate member being substantially free from attachment to said post member and having a generally convex lower bearing surface on said heel portion thereof for resting in engagement with said concave upper surface of said post member; and a raised ridge formed on said upper surface of said post member and extending along medial and lateral sides of said heel cup so as to form a bearing interface with said convex lower surface of said plate member which enables said plate member to pivot on said post member through a predetermined range of motion.

* * * * *